US009561533B2

(12) United States Patent
Schmauder et al.

(10) Patent No.: US 9,561,533 B2
(45) Date of Patent: Feb. 7, 2017

(54) MACHINE TOOL FOR PROCESSING WORKPIECES

(71) Applicant: TRUMPF Werkzeugmaschinen GmbH + Co. KG, Ditzingen (DE)

(72) Inventors: Frank Schmauder, Metzingen (DE); Jochen Wruck, Pasching (AT); Detlef Breitling, Leonberg (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 438 days.

(21) Appl. No.: 14/088,757

(22) Filed: Nov. 25, 2013

(65) Prior Publication Data

US 2014/0090443 A1 Apr. 3, 2014

Related U.S. Application Data

(63) Continuation of application No. PCT/EP2012/059416, filed on May 22, 2012.

(30) Foreign Application Priority Data

May 26, 2011 (EP) ..... 11167704

(51) Int. Cl.
*B21D 39/02* (2006.01)
*B21D 28/20* (2006.01)
(Continued)

(52) U.S. Cl.
CPC ..... *B21D 28/20* (2013.01); *B21D 28/002* (2013.01); *B30B 1/40* (2013.01); *Y10T 83/8841* (2015.04)

(58) Field of Classification Search
CPC ..... B21D 28/20; B21D 28/002; B30B 1/40; Y10T 83/8841
(Continued)

(56) References Cited

U.S. PATENT DOCUMENTS 2,199,864 A * 5/1940 Wehr ..... B21D 5/0272 72/448
3,743,469 A * 7/1973 Gibbons ..... B29C 45/68 100/271
(Continued)

FOREIGN PATENT DOCUMENTS

DE 19954441 A1 2/2001
WO WO2007122294 A1 11/2007

OTHER PUBLICATIONS

International Search Report for corresponding PCT Application No. PCT/EP2012/059416, mailed Jul. 10, 2012, 4 pages.
(Continued)

*Primary Examiner* — David B Jones
(74) *Attorney, Agent, or Firm* — Fish & Richardson P.C.

(57) ABSTRACT

A machine tool for processing workpieces comprises a stroke drive device with a pressing tool, with a motorized drive including two motorized drive units which are controlled independently and wedge gear elements between the motorized drive and the pressing tool. The wedge gear elements comprise two drive-side wedge gear elements, each one being associated with a motorized drive unit, and two output-side wedge gear elements attached to the pressing tool, with each output-side wedge gear element opposite to an associated respective drive-side wedge gear element and forming a gear element pair. The wedge gear elements of each gear element pair are opposite each other inclined at a wedge angle with respect to a positioning axis and inclined in opposing directions with respect to the positioning axis. The motorized drive is configured to move the pressing tool along a stroke axis and position the stroke drive device along the positioning axis.

19 Claims, 8 Drawing Sheets

(51) Int. Cl.
*B21D 28/00* (2006.01)
*B30B 1/40* (2006.01)

(58) Field of Classification Search
USPC ..... 72/452.9; 83/627
See application file for complete search history.

(56) References Cited

U.S. PATENT DOCUMENTS

| | | | | | |
|---|---|---|---|---|---|
| 3,982,416 | A * | 9/1976 | Pozsgay | B21B 21/005 | 72/214 |
| 4,157,027 | A * | 6/1979 | Graham | B21D 1/08 | 29/402.19 |
| 4,535,689 | A * | 8/1985 | Putkowski | B30B 1/40 | 100/214 |
| 5,376,988 | A * | 12/1994 | Osanai | F16C 29/025 | 355/53 |
| 6,030,569 | A * | 2/2000 | Yu | B29C 45/661 | 264/272.17 |
| 6,101,863 | A | 8/2000 | Liinamaa | | |
| 6,644,089 | B1 | 11/2003 | Goergen | | |
| 2014/0090443 | A1 * | 4/2014 | Schmauder | B21D 28/002 | 72/452.9 |

OTHER PUBLICATIONS

Notification of Transmittal of Translation of the International Preliminary Report of Patentability and Written Opinion from corresponding PCT Application No. PCT/EP2012/059416, mailed Dec. 5, 2013, 7 pages.

* cited by examiner

MACHINE TOOL FOR PROCESSING WORKPIECES

CROSS REFERENCE TO RELATED APPLICATIONS

This application is a continuation of and claims priority under 35 U.S.C. §120 to PCT Application No. PCT/EP2012/059416, filed on May 22, 2012, which claims priority to European Application No. 11 167 704.3, filed on May 26, 2011. The contents of the prior applications are hereby incorporated by reference in their entirety.

TECHNICAL FIELD

The invention relates to a machine tool for processing workpieces, in particular metal sheets.

BACKGROUND

WO 2007/122294 A1 discloses a punching press having a horizontal workpiece support above which a plurality of punching stamps are arranged in rows in a horizontal direction. Above the punching stamps, a stroke drive device which is provided for the punching stamps can be moved along the punching stamp row. Part of the stroke drive device is a ram carriage which can be displaced along the punching stamp row. A ram is movably guided in a vertical direction on the ram carriage. The lower end of the ram faces the punching stamps. At the upper side thereof, the ram is provided with two gear type wedges of a wedge gear. The two gear type wedges are combined to form a structurally unitary wedge arrangement. The wedge arrangement is delimited at the upper side thereof by the wedge faces of the two gear type wedges. The two wedge faces are inclined in opposing directions relative to the horizontal and form at the ram-side wedge arrangement a roof-like dual wedge face. In a vertical direction, a drive-side wedge arrangement is opposite the ram-side wedge arrangement. The drive-side wedge arrangement is also constructed as a structural unit comprising two gear type wedges having wedge faces which are inclined in opposing directions relative to the horizontal and which abut each other in a roof-like manner. Using a motorized spindle drive, the drive-side wedge arrangement can be moved along the punching stamp row and consequently in the displacement direction of the ram carriage. Close to the roof-like dual wedge face, a protrusion protrudes downwards at the drive-side wedge arrangement. A recess on a base plate of the ram-side wedge arrangement is associated with this protrusion. The drive-side protrusion and the ram-side recess can be selectively brought into engagement with each other or out of engagement with each other.

If a selected punching stamp of the punching stamp row is intended to carry out a working stroke for the workpiece processing, and if the ram which is guided on the ram carriage is arranged remote from the selected punching stamp, the ram must first be moved in a horizontal direction into a position in which it is located above the punching stamp which is intended to be actuated by him. To this end, the drive-side wedge arrangement is moved by the motorized spindle drive along the punching stamp row into a position in which the protrusion which protrudes downwards on the drive-side wedge arrangement is arranged opposite of the recess provided in the base plate of the ram-side wedge arrangement. The base plate and also the ram-side wedge arrangement itself are in this instance first lowered in a vertical direction so far that the drive-side protrusion can travel sufficiently far over the base plate of the ram-side wedge arrangement. Subsequently, by a lifting movement of the ram-side wedge arrangement and the base plate thereof, the ram-side recess and the drive-side protrusion are brought into mutual engagement. If the drive-side wedge arrangement is now moved in a motor-driven manner, it carries, via the base plate of the ram-side wedge arrangement, this and the entire ram carriage in the displacement direction. The displacement movement ends as soon as the ram on the ram carriage has reached its desired position above the punching stamp to be actuated. In order to secure the desired position of the ram, the ram carriage is secured on the guide thereof. Subsequently, the ram-side wedge arrangement and the base plate thereof are lowered to such an extent that the protrusion on the drive-side wedge arrangement can leave the recess in the base plate of the ram-side wedge arrangement. Regardless of the lowering movement of the ram-side wedge arrangement and the base plate thereof, the ram is spaced apart as before at its lower side from the punching stamp associated therewith. If the drive-side wedge arrangement is now driven in a motorized manner in the displacement direction thereof, it moves relative to the ram-side wedge arrangement on the ram carriage which is secured in the displacement direction. When the drive-side wedge arrangement moves relative to the ram-side wedge arrangement, owing to the cooperation of the wedge faces at both sides, the ram which is guided in a vertical direction on the ram carriage is moved downwards with a working stroke being carried out. In this instance, the ram acts on the punching stamp opposite it in the vertical direction and this stamp carries out the desired workpiece punching processing operation.

SUMMARY

An advantage of the present invention is to simplify the prior art. The machine tool described herein includes drive-side wedge gear elements that are at the same time opposite an associated output-side wedge gear element on the respective wedge face. Furthermore, a motorized drive for the wedge gear elements of the wedge gear has two motorized drive units, which are controlled independently of each other and in such a manner that to move the pressing tool along the stroke axis, they move the drive-side wedge gear element of at least one gear element pair relative to the associated output-side wedge gear element and/or that to position the stroke drive device along the positioning axis, they move the drive-side wedge gear elements of both gear element pairs at the same time with the respective associated output-side wedge gear element along the positioning axis of the stroke drive device. Under these circumstances, it can be determined simply by appropriate control of the motorized drive units whether the stroke drive device moves with a positioning movement along the positioning axis, whether the stroke drive device brings about a movement of the pressing tool in the stroke direction thereof or whether a positioning movement of the stroke drive device and a stroke of the pressing tool are superimposed on each other. One and the same motorized drive can consequently be used on machine tools for two axial movements of the pressing tool.

In some embodiments, the motorized drive units for the wedge gear elements of the wedge gear can be controlled in such a manner that they simultaneously bring about a relative movement of the drive-side and the output-side wedge gear element of at least one gear element pair and a common movement of the drive-side and the output-side wedge gear elements of both gear element pairs in the direction of the positioning axis of the stroke drive device. This operating mode of the motorized drive units results in a superimposition of a positioning movement of the stroke drive device and a stroke drive movement which can be used to drive a pressing tool in the stroke direction.

It is possible in another embodiment to move the drive-side wedge gear elements of both gear element pairs at the same time relative to the respective associated output-side wedge gear element along the positioning axis of the stroke drive device. In this manner a maximum drive force can be provided along the stroke axis (e.g., in the stroke direction of a working stroke).

For the association of the two motorized drive units which can be controlled independently of each other with respect to the wedge gear elements, there are several possibilities.

The two motorized drive units are provided for the drive-side wedge gear elements. Depending on the operating mode of the motorized drive units, the drive-side wedge gear elements carry the output-side wedge gear elements which are associated therewith with the stroke drive device being positioned in the positioning direction thereof or—as an alternative to the positioning movement of the stroke drive device or superimposed therewith—there is produced a relative movement between the drive-side wedge gear elements and the output-side wedge gear elements which are associated therewith, as a result of which the pressing tool can be driven along the stroke axis. The wedge gear elements of the wedge gear consequently perform a multiple function.

In some embodiments, one of the two motorized drive units brings about the movement of the pressing tool along the stroke axis, the other motorized drive unit brings about the positioning of the stroke drive device along the positioning axis.

The configuration of the wedge gear mechanism enables optimal load transfer with a compact construction of the wedge gear mechanism. Owing to the drive-side wedge gear element of one of the gear element pairs being divided into two spaced-apart gear element portions, a wide base is available for the support of this drive-side wedge gear element. Since the drive-side wedge gear element of the other gear element pair can be introduced between the two gear element portions, the wedge gear mechanism has relatively small dimensions in the movement direction of the drive-side wedge gear elements.

In the interest of the simplest structural configuration of the entire arrangement possible, in some embodiments the output-side wedge gear elements are provided on a ram which serves to actuate the pressing tool.

In another preferred embodiment, the ram is guided along the stroke axis via the output-side wedge gear elements provided on the ram.

In some embodiments of the machine tool, in which the ram is provided with a tool receiving member for the pressing tool and with a rotary drive device, by which the tool receiving member provided on the ram can be rotated about the stroke axis and can thereby be positioned in different rotational positions about the stroke axis. A rotational adjustment of the tool receiving member about the stroke axis is required in order to define a direction of the workpiece processing operation carried out by the pressing tool.

For the motorized drive units of the drive, different embodiments are conceivable, such as spindle drives and/or linear motors. In some embodiments, the motorized drive units of the two gear element pairs have a common carrier-structure-side drive device. Spindle drives are provided and include as a gear-side drive device a spindle nut or a spindle nut and a drive motor for the spindle nut and as a common carrier-structure-side drive device a common drive spindle. Torque motors may be used as drive motors. The drive of the spindle nut positioned on the drive spindle may, for example, be constructed as a ball screw, a trapezoidal screw drive or a roller or planetary screw drive.

The motorized drive units of the motorized drive are constructed as linear motors. In this instance, both synchronous and asynchronous linear motors may be used in principle. Owing to the better efficiency and the higher feed forces, however, synchronous linear motors are preferred. In any case, the drive-side wedge gear elements are provided with the primary part of the respective linear motor. A secondary part which extends along the positioning axis of the stroke drive device is fitted to the carrier structure as a common carrier-structure-side drive device of the two motorized drive units.

In addition to spindle drives and linear motors it is also possible to use, for example, rack and pinion drives or chain drives as motorized drive units for the motorized drive.

Owing to the movability thereof along a positioning axis which extends perpendicularly relative to the stroke axis, the stroke drive device with a pressing tool provided thereon may approach the processing locations on a workpiece which is intended to be processed. For mutual positioning of the workpiece and pressing tool, no movement or only a relatively small movement of the workpiece is required in the direction of the positioning axis. For this reason, only a relatively small movement range has to be provided for the workpiece in the direction of the positioning axis. This circumstance affords the possibility of accommodating the required movement range of workpieces to be processed within an O-shaped machine frame. Such a geometry of the machine frame is particularly advantageous for presses of the type described herein. Even when high pressing forces are introduced, an O-shaped machine frame is deformed at most to a minimum extent. The use of a conventional coordinate guide for the workpiece movement is conceivable regardless of the positionability of the stroke drive device. A coordinate guide can carry out a workpiece movement preferably perpendicular relative to the positioning and stroke axis but also along the positioning axis.

DETAILED DESCRIPTION

Figure 1:
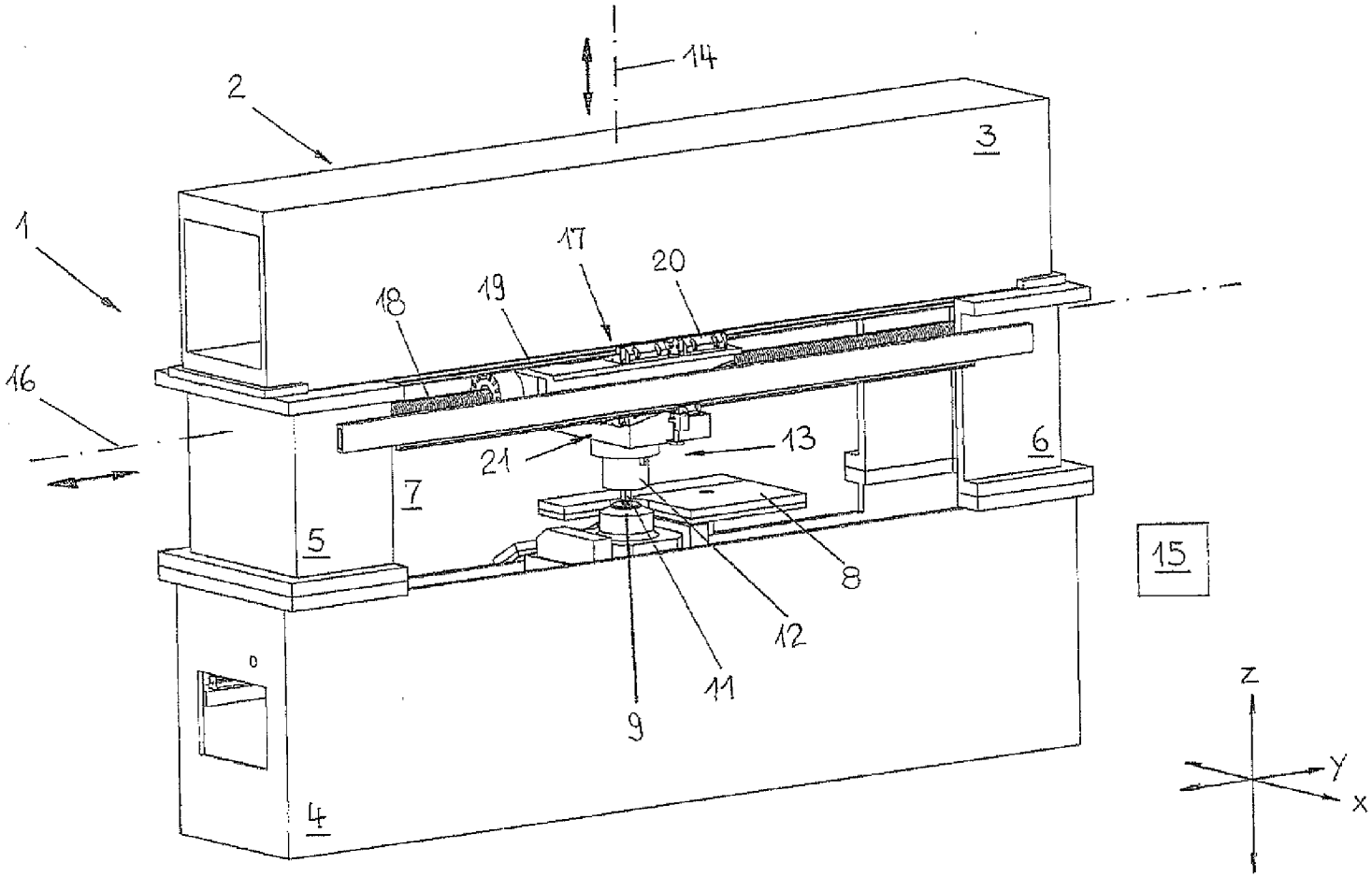
FIG. 1 shows a machine tool in the form of a punching press having a stroke drive device for a punching stamp including a motorized drive for the stroke drive device.

As shown in FIG. 1, a machine tool which is constructed as a punching press 1 has as a carrier structure an O-shaped machine frame 2 with two horizontal frame members 3, 4 and two vertical frame members 5, 6. The machine frame 2 surrounds an inner frame space 7 which forms the operating range of the punching press 1.

Metal sheets which are not illustrated for reasons of simplification and which are arranged for processing purposes in the inner frame space 7 are processed using the punching press 1. A metal sheet to be processed is deposited on a workpiece support 8 provided in the inner frame space 7. In a recess of the workpiece support 8, there is supported on the lower horizontal frame member 4 of the machine frame 2 a lower pressing tool in the form of a punching die 9 of conventional construction type. In the conventional manner, the punching die 9 is provided with a die opening.

During punching workpiece processing, an upper pressing tool or punching stamp 11 is introduced into the die opening of the punching die 9. In place of a punching stamp 11 and a punching die 9, a bending stamp and a bending die for forming workpieces are, for example, also conceivable.

The punching stamp 11 is fixed in a tool receiving member at the lower end of a ram 12. The ram 12 is part of a stroke drive device 13, by which the punching stamp 11 can be moved in a stroke direction (shown by a double-headed arrow) along a stroke axis 14. The stroke axis 14 extends in the direction of the z axis of the coordinate system of a numerical control unit 15 of the punching press 1. The stroke drive device 13 can be moved perpendicularly relative to the stroke axis 14 along a positioning axis 16 in the direction of a double-headed arrow. The positioning axis 16 extends in the direction of the y axis of the coordinate system of the numerical control unit 15. During movements of the stroke drive device 13 along the positioning axis 16, the punching die 9 and the workpiece support 8 are moved synchronously with the stroke drive device 13 by a motorized drive which is not shown in detail. A stroke drive device is also conceivable for the punching die 9.

The movement of the ram 12 along the stroke axis 14 and the positioning of the stroke drive device 13 along the positioning axis 16 are carried out by a motorized drive in the form of a spindle drive arrangement 17 having a drive spindle 18 which extends in the direction of the positioning axis 16 and which is securely connected to the machine frame 2. The stroke drive device 13 is guided during movements along the positioning axis 16 on a total of three guide rails 19 on the upper horizontal frame leg 3. Of the guide rails 19, one can be seen in FIG. 1. The two remaining guide rails 19 extend parallel to the visible guide rail 19 and are spaced apart therefrom in the direction of the x axis of the coordinate system of the numerical control unit 15. Guide blocks 20 of the stroke drive device 13 run on the guide rails 19. The mutual engagement of the guide rails 19 and the guide blocks 20 is constructed in such a manner that the connection between the guide rails 19 and the guide blocks 20 can also absorb a load acting in a vertical direction. Accordingly, the stroke drive device 13 is suspended on the machine frame 2 by the guide blocks 20 and the guide rails 19.

Figure 2:
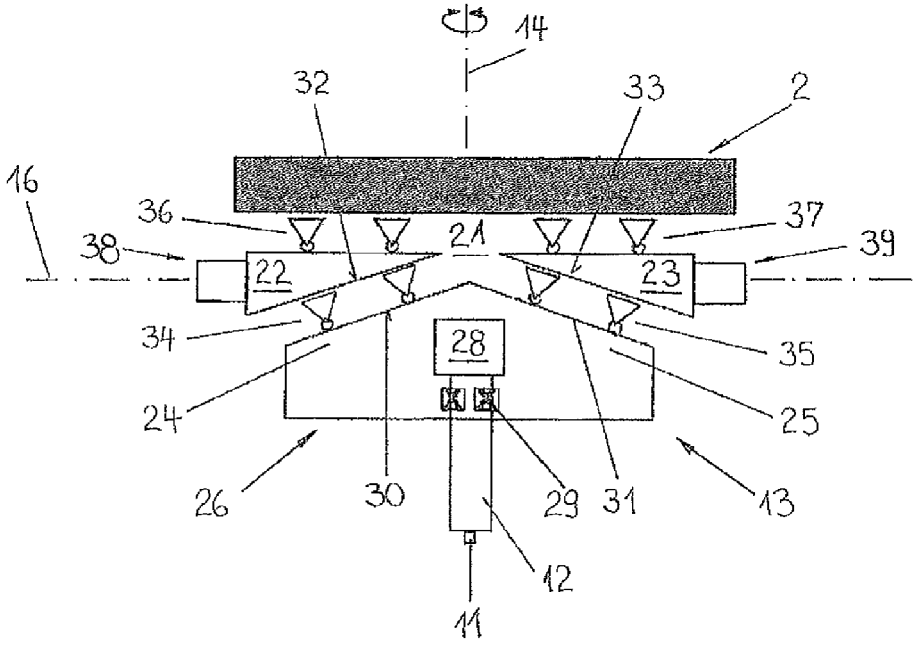
FIG. 2 is a highly schematic illustration of the basic structure of the stroke drive device and the motorized drive of FIG. 1, FIGS. 3 to 5 show gear elements of a wedge gear mechanism of the stroke drive device of FIG. 1, FIGS. 6 to 8 show the punching press of FIG. 1 in three different operating states of the stroke drive device.

Another component of the stroke drive device 13 is a wedge gear 21, which is covered to a large extent in FIG. 1. The basic structure and the basic operation of the wedge gear 21 are illustrated in FIG. 2. The wedge gear 21 includes two drive-side wedge gear elements 22, 23 and two output-side wedge gear elements 24, 25. The latter are structurally combined to form a structural unit in the form of an output-side dual wedge 26.

On the output-side dual wedge 26, the ram 12 is rotatably supported about the stroke axis 14. A motorized rotary drive device 28 is accommodated in the output-side dual wedge 26 and positions the ram 12 about the stroke axis 14 if necessary. In this instance, both a left-hand and a right-hand rotation of the ram 12 is possible (as indicated by the double-headed arrow in FIG. 2). A ram support 29 is also shown in FIG. 2. The ram support 29 allows low-friction rotational movements of the ram 12 about the stroke axis 14 and supports the ram 12 in an axial direction and transfers loads which act on the ram 12 in the direction of the stroke axis 14 onto the drive-side dual wedge 26.

The output-side dual wedge 26 is delimited in an upward direction by a wedge face 30 of the output-side wedge gear element 24 and by a wedge face 31 of the output-side wedge gear element 25. Wedge faces 32, 33 of the drive-side wedge gear elements 22, 23 are opposite the wedge faces 30, 31 of the output-side wedge gear elements 24, 25. Longitudinal guides 34, 35 which will be described in detail below and which are illustrated in FIG. 2 in a highly schematic manner movably guide the drive-side wedge gear element 22 and the output-side wedge gear element 24 as well as the drive-side wedge gear element 23 and the output-side wedge gear element 25 relative to each other in the direction of the y axis, (i.e., in the direction of the positioning axis 16 of the stroke drive device 13). The drive-side wedge gear element 22 and the output-side wedge gear element 24 as well as the drive-side wedge gear element 23 and the output-side wedge gear element 25 respectively form a gear element pair. In a variation from the relationships illustrated, a wedge gear with gear element pairs is also conceivable, in which case only one of the wedge gear elements which are associated with each other has a wedge face which is inclined relative to the positioning axis 16.

Longitudinal guides 36, 37 at the upper side of the drive-side wedge gear elements 22, 23 are formed by the guide rails 19 described above on the machine frame 2 and by the guide blocks 20 of the stroke drive device 13 mounted on the drive-side wedge gear elements 22, 23.

The drive-side wedge gear element 22 has a motorized drive unit 38 and the drive-side wedge gear element 23 has a motorized drive unit 39. Both drive units 38, 39 together form the spindle drive arrangement 17.

The motorized drive units 38, 39 share use of the drive spindle 18 shown in FIG. 1 as a drive device and which is supported on the machine frame 2 and is consequently a carrier-structure-side drive device. Shown in FIG. 3, a gear-side drive device of the motorized drive unit 38 includes an electrical drive motor 40 and a spindle nut 41 which is driven thereby and which rests on the drive spindle 18. The motorized drive unit 39 has an electrical drive motor 42 and a spindle nut 43 as a gear-side drive device (FIG. 4). The electrical drive motor 40 and the spindle nut 41 move together with the drive-side wedge gear element 22 along the positioning axis 16 and the electrical drive motor 42 and the spindle nut 43 are coupled with the drive-side wedge gear element 23 for movement along the positioning axis 16.

As with all significant functional units of the punching press 1, the motorized drive units 38, 39 of the wedge gear 21 are also controlled by the numerical control 15 of the punching press 1. Both for the control of the drive-side wedge gear elements 22, 23 and for the control of the output-side dual wedge 26, suitable displacement encoders are provided.

As can also be seen from FIG. 2, the drive-side wedge gear elements 22, 23 are at the same time opposite the associated output-side wedge gear element 24, 25 at the wedge faces 30, 32 or at the wedge faces 31, 33, respectively.

If the electrical drive motors 40, 42 on the drive-side wedge gear elements 22, 23 are operated in such a manner that the drive-side wedge gear elements 22, 23 move towards each other along the positioning axis 16, there is produced a relative movement between the drive-side wedge gear elements 22, 23 and the output-side wedge gear elements 24, 25. Owing to this relative movement, the output-side dual wedge 26 with the ram 12 supported thereon is moved downwards along the stroke axis 14. The punching stamp 11 which is mounted on the ram 12 carries out a working stroke and processes a workpiece which is supported on the workpiece support 8.

If the drive-side wedge gear elements 22, 23 are moved by corresponding control of the electrical drive motors 40, 42 relative to the output-side wedge gear elements 24, 25 and away from each other, the output-side dual wedge 26 and the ram 12 which is supported thereon are lifted with the punching stamp 11 along the stroke axis 14.

If the drive-side wedge gear elements 22, 23 move owing to a corresponding control of the electrical drive motors 40, 42 in the same direction along the positioning axis 16, the drive-side wedge gear elements 22, 23 carry the output-side dual wedge 26 with the ram 12 and the punching stamp 11 along the positioning axis 16. The stroke drive device 13 and with it the ram 12 and the punching stamp 11 are thereby positioned in the direction of the y axis. If, during the movement of the drive-side wedge gear elements 22, 23 along the positioning axis 16, the spacing existing in this direction between the drive-side wedge gear elements 22, 23 does not change, the ram 12 and the punching stamp 11 change their position exclusively in the direction of the positioning axis 16 but not in the direction of the stroke axis 14.

It is also conceivable to superimpose a positioning movement along the positioning axis 16 and a stroke movement along the stroke axis 14. To this end, the electrical drive motors 40, 42 must be controlled in such a manner that the drive-side wedge gear elements 22, 23 move in the same direction and at the same time relative to each other and the output-side wedge gear elements 24, 25 along the positioning axis 16.

Figure 3:
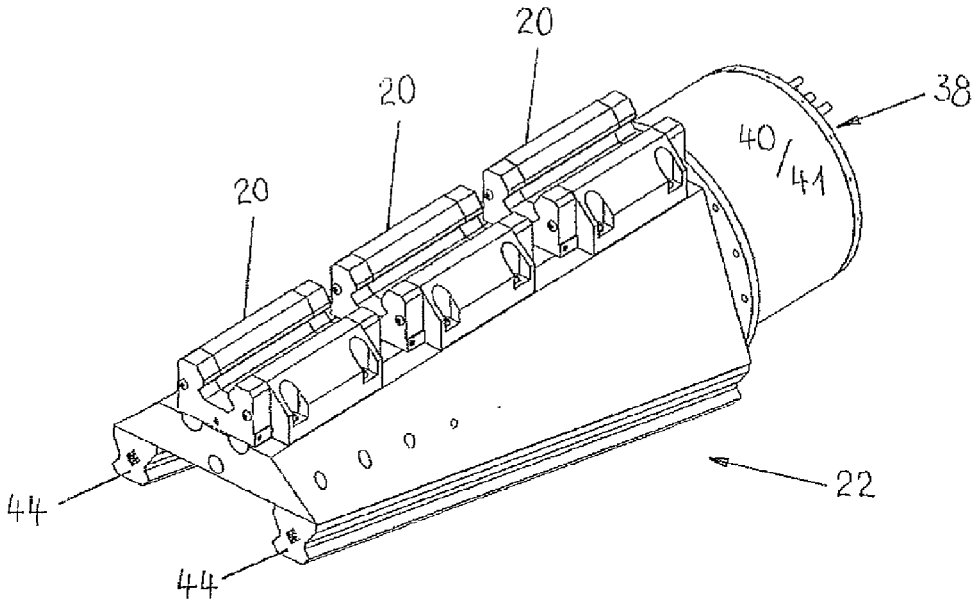
Figure 4:
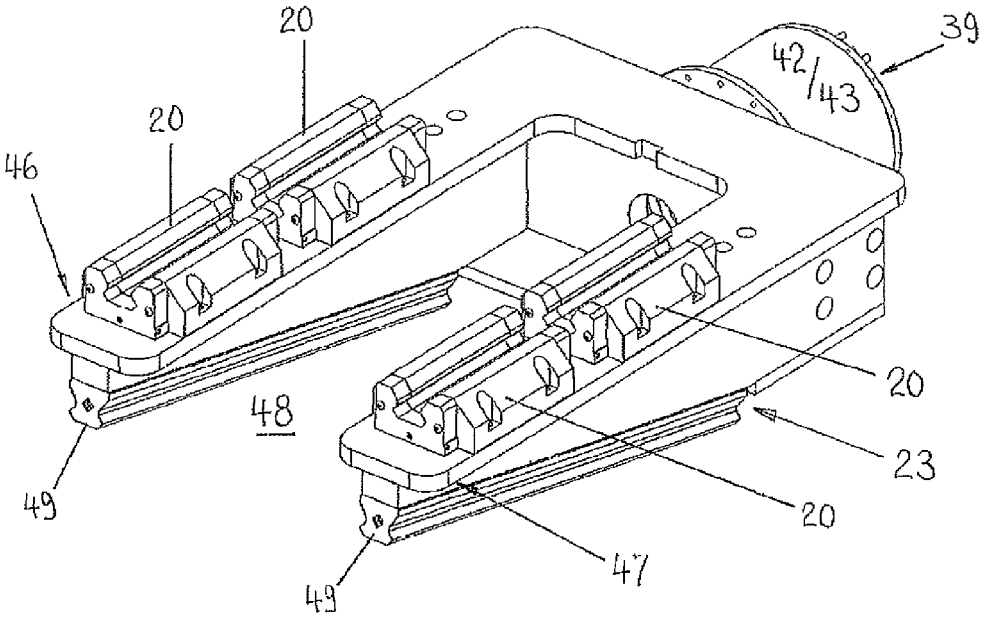
Figure 5:
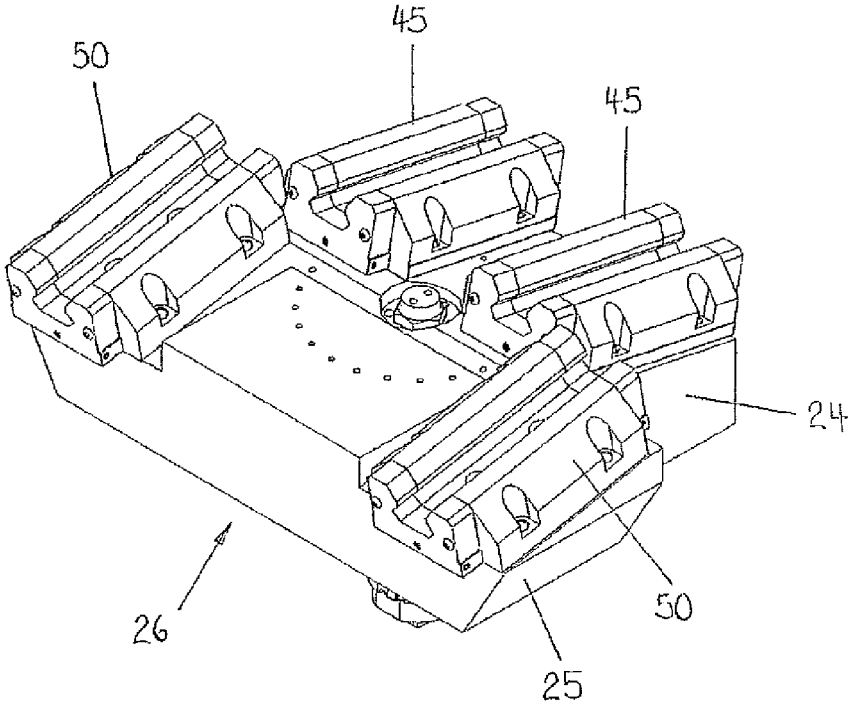

FIGS. 3, 4 and 5 show the drive-side wedge gear element 22, the drive-side wedge gear element 23 and the output-side wedge gear elements 24, 25 or the output-side dual wedge 26 formed thereby in detail.

The guide blocks 20 at the upper side of the drive-side wedge gear element 22, the guide blocks 20 cooperating with the guide rails 19 on the machine frame 2 and forming the longitudinal guide 36 of FIG. 2 as well as guide rails 44 at the lower side of the drive-side wedge gear element 22 can be seen in FIG. 3. In a common housing in FIG. 3, the electrical drive motor 40 and the spindle nut 41 of the motorized drive unit 38 are arranged so as to be covered. The electrical drive motor 40 is constructed as a torque motor and fitted directly with the rotor thereof to the spindle nut 41.

The guide rails 44 on the drive-side wedge gear element 22 engage in the assembled state in guide blocks 45 at the output-side dual wedge 26 of FIG. 5. Together, the guide rails 44 and the guide blocks 45 form the longitudinal guide 34 indicated in FIG. 2, by which the drive-side wedge gear element 22 and the output-side dual wedge 26 are supported on each other in a vertical direction.

The drive-side wedge gear element 23 shown in FIG. 4 is U-shaped and forms with the U-legs gear element portions 46, 47 which face each other, with an intermediate space 48 being formed therebetween. The guide blocks 20 of the longitudinal guide 37 (which is schematically illustrated in FIG. 2) associated with the guide rails 19 of the machine frame 2 are assembled at the upper side of the gear element portions 46, 47. The lower side of the gear element portions 46, 47 includes guide rails 49. These run in guide blocks 50 at the upper side of the drive-side dual wedge 26 (FIG. 5) and together therewith form the longitudinal guide 35 of FIG. 2. The drive-side wedge gear element 23 and the output-side dual wedge 26 are supported on one another in the vertical direction via the longitudinal guide 35. The gear-side drive device of the motorized drive unit 39 of the drive-side wedge gear element 23, said gear-side drive device including the electrical drive motor 42 and the spindle nut 43, structurally correspond to the gear-side drive device for the drive-side wedge gear element 22.

Depending on the position in which the drive-side wedge gear elements 22, 23 are arranged along the positioning axis 16 relative to each other, there is produced a different height position of the ram 12 and the punching stamp 11 along the stroke axis 14. This is illustrated in FIGS. 6 to 8 in detail.

Figure 6:
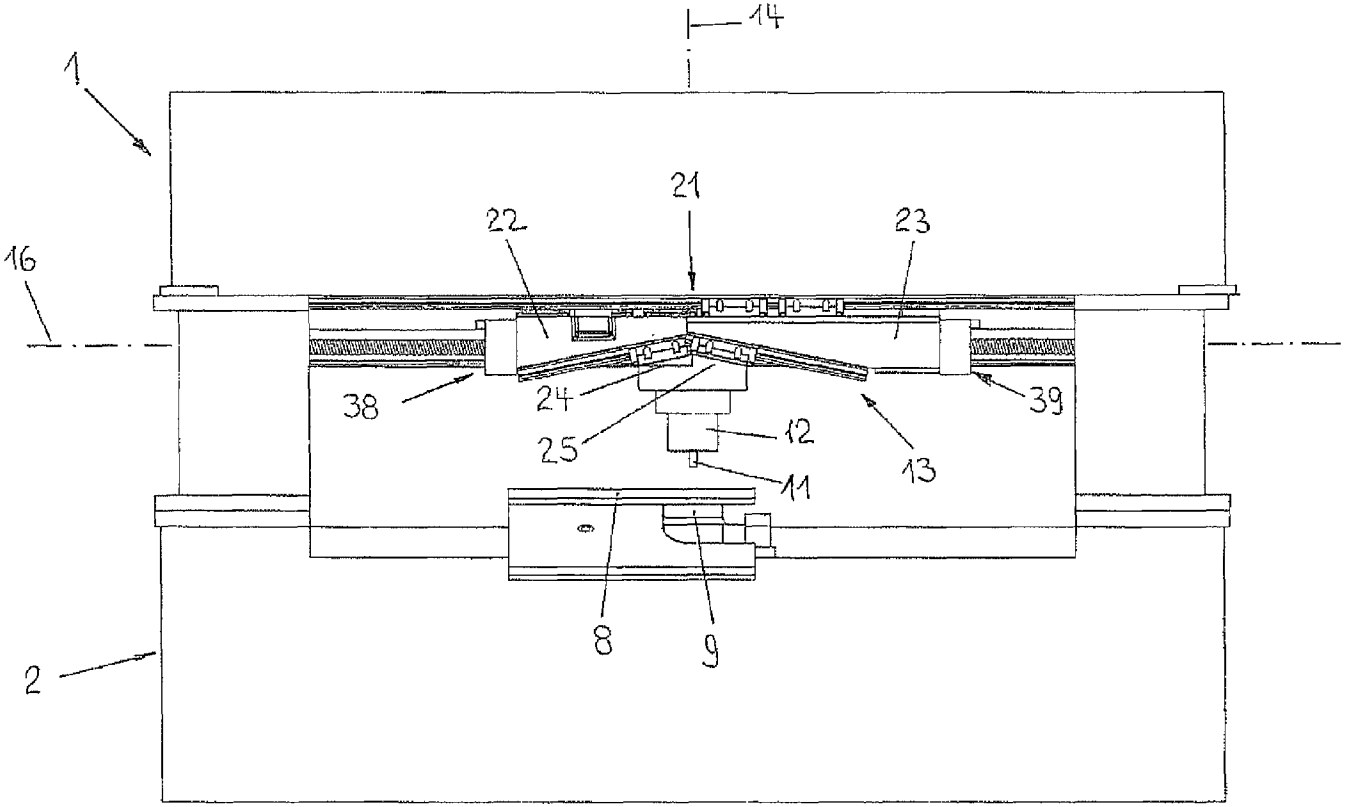

In FIG. 6, the drive-side wedge gear elements 22, 23 are moved away from each other to the maximum extent along the positioning axis 16. Accordingly, the ram 12 and the punching stamp 11 assume their upper end position along the stroke axis 14.

Figure 7:
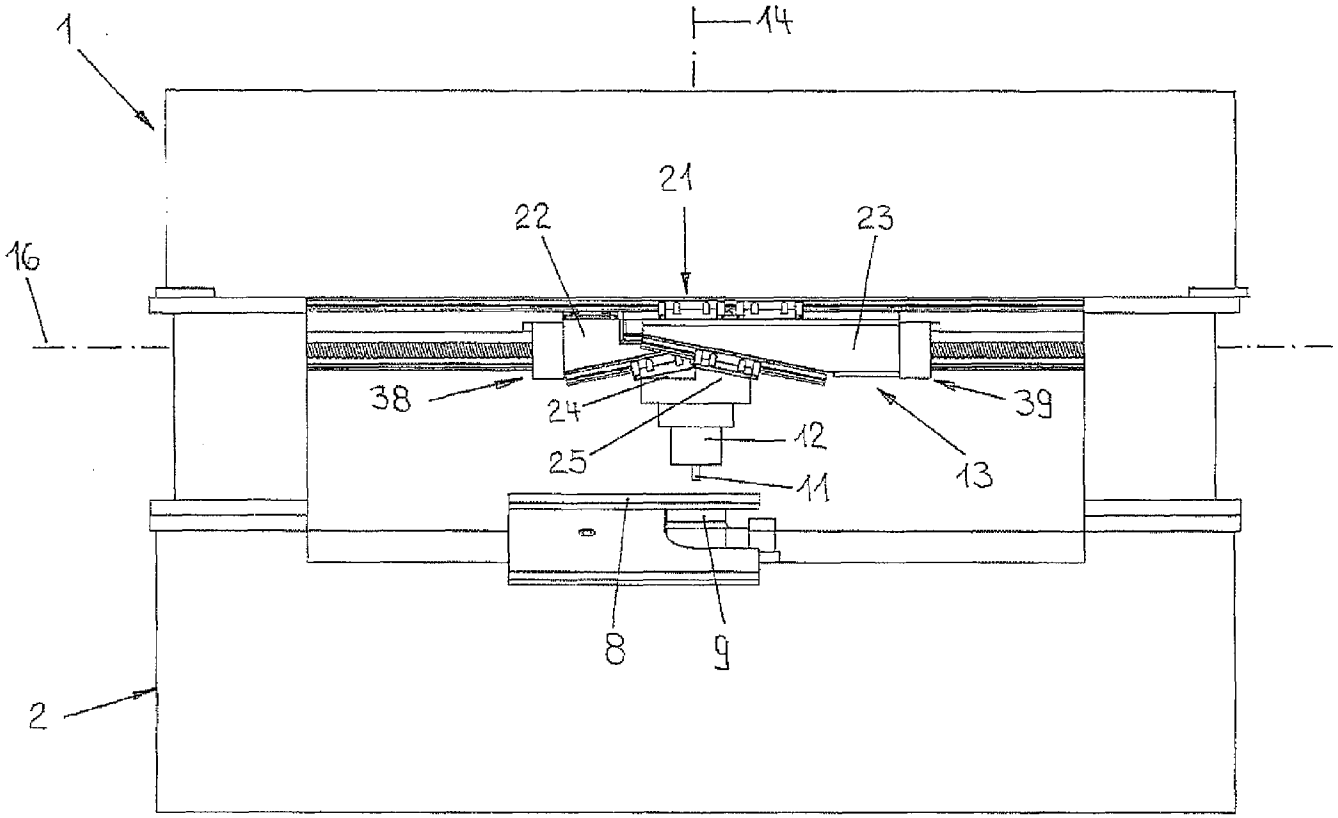

If, starting from the relationships of FIG. 6, the drive-side wedge gear elements 22, 23 are moved towards each other along the positioning axis 16, the ram 12 moves with the punching stamp 11 along the stroke axis 14 in a downward direction and assumes at some point the position shown in FIG. 7.

Figure 8:
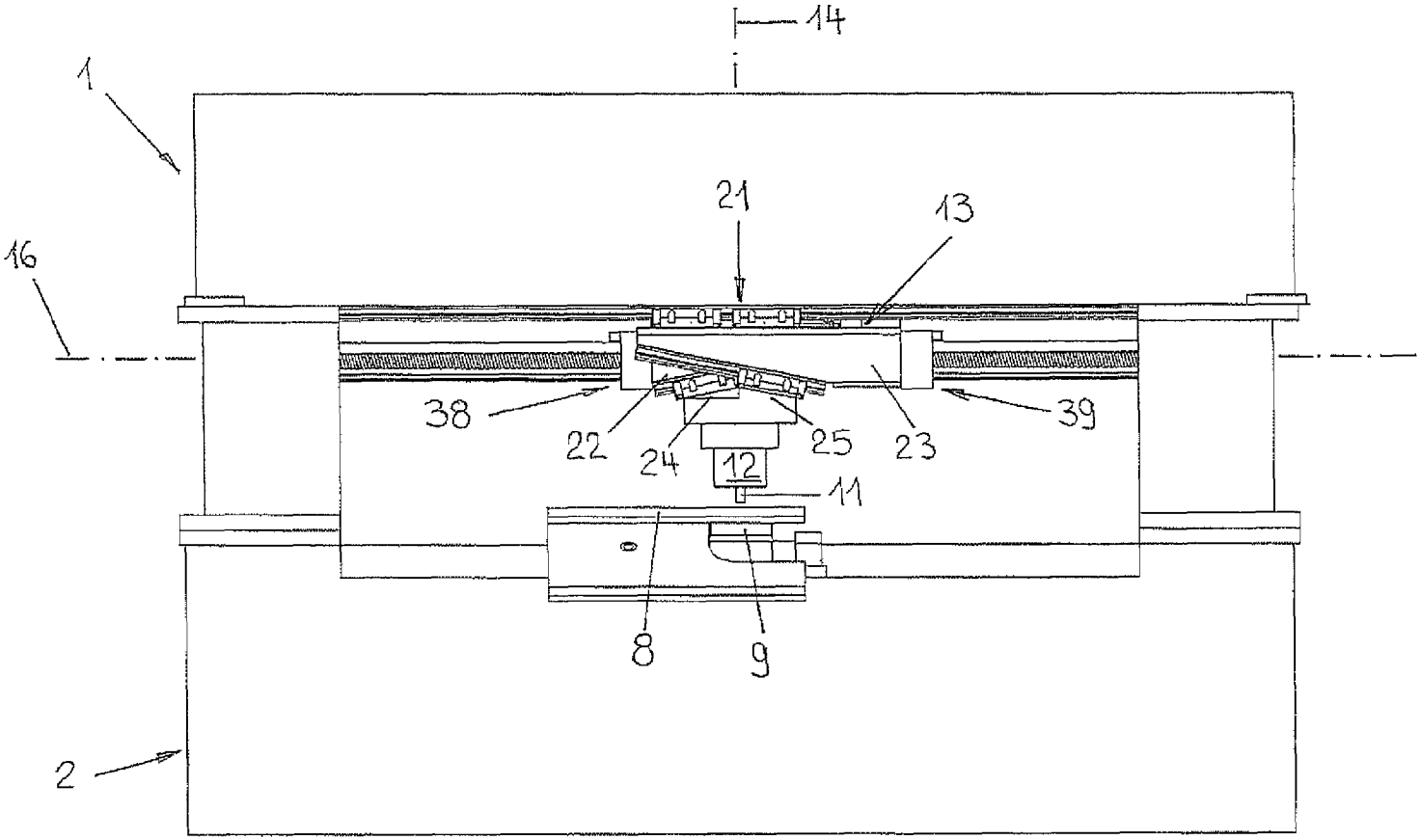

If the drive-side wedge gear elements 22, 23 continue their opposing movement, the relationships of FIG. 8 are produced. In FIG. 8, the punching stamp 11 which is fitted to the ram 12 has almost reached the punching die 9. In the event of further opposing movement of the drive-side wedge gear elements 22, 23, the punching stamp 11 is finally introduced into the punching die 9.

During the opposing movement of the drive-side wedge gear elements 22, 23 along the positioning axis 16, the drive-side wedge gear element 22 is increasingly introduced into the intermediate space 48 of the gear element portions 46, 47 of the U-shaped drive-side wedge gear element 23. The longitudinal guides 34, 35 which are provided between the output-side dual wedge 26 and the drive-side wedge gear elements 22, 23 ensure that the ram 12 is guided during its movement along the stroke axis 14. Other guiding devices are not provided for the lifting and lowering movements of the ram 12. The stroke of the ram 12 illustrated in FIGS. 6 to 8 may be combined with a positioning movement of the stroke drive device 13 along the positioning axis 16.

Figure 9:
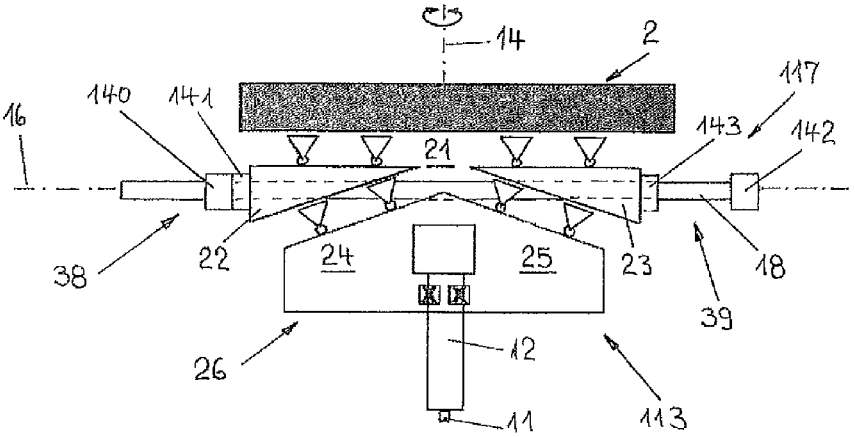
FIG. 9 is a schematic illustration of a stroke drive device including a motorized drive of a second construction type.
Figure 10:
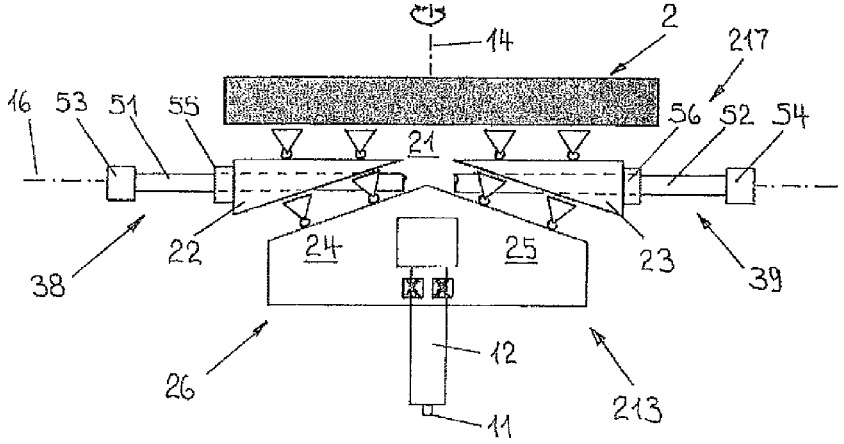
FIG. 10 is a schematic illustration of a stroke drive device including a motorized drive of a third construction type.
Figure 11:
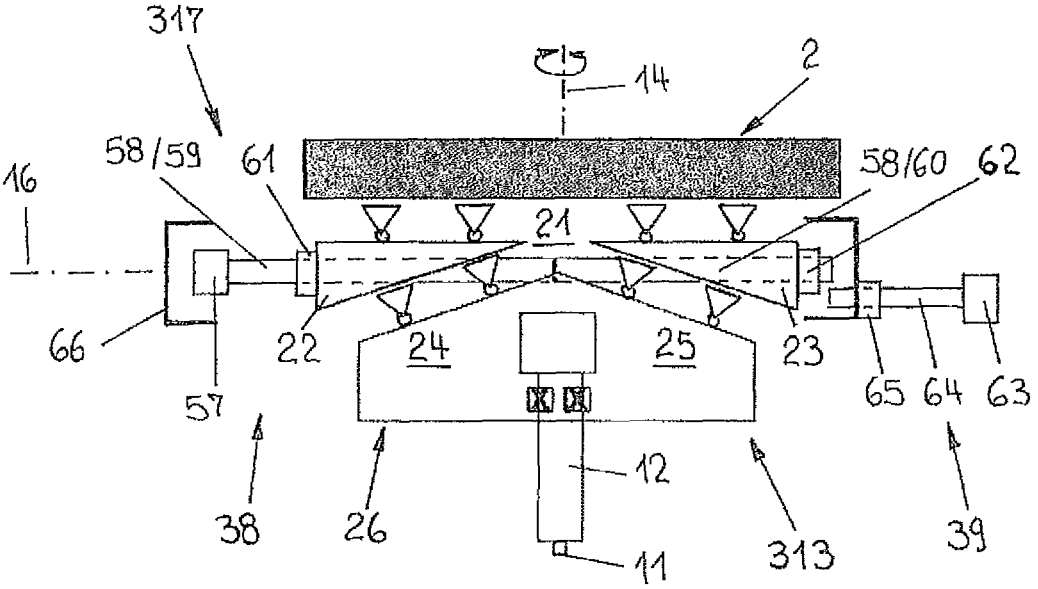
FIG. 11 is a schematic illustration of a stroke drive device including a motorized drive of a fourth construction type.

FIGS. 9, 10 and 11 illustrate stroke drive devices 113, 213, 313 which may be provided on the punching press 1 in place of the stroke drive device 13 described in detail above. The stroke drive devices 113, 213, 313 differ from the stroke drive device 13 by having spindle drive arrangements 117, 217, 317 which are provided as motorized drives. The stroke drive device 13 and the stroke drive devices 113, 213, 313 correspond to each other with regard to the wedge gear 21 used.

Furthermore, the spindle drive arrangement 117 shown in FIG. 9 corresponds to the spindle drive arrangement 17 in that the motorized drive units 38, 39 of the spindle drive arrangement 117 are also constructed as spindle drives with a common drive spindle 18 which acts as a carrier-structure-side drive device and which extends along the positioning axis 16. The drive spindle 18 has over the entire length thereof a uniform outer thread and can be driven by an electrical drive motor 142 about the longitudinal axis thereof. In the case of the motorized drive units 38, 39 of FIG. 9 there are provided an electrical drive motor 140 and a spindle nut 141 on the drive-side wedge gear element 22 as well as a spindle nut 143 on the drive-side wedge gear element 23 as gear-side drive devices. The spindle nut 143 is mounted on the drive-side wedge gear element 23 so as to be rotationally secure with respect to the rotation axis of the drive spindle 18. The spindle nut 141 is supported on the drive-side wedge gear element 22 so as to be able to be rotated about the rotation axis of the drive spindle 18. Using the drive motor 140, the spindle nut 141 can be driven about the rotation axis of the drive spindle 18, but also blocked against such a rotational movement.

If the wedge gear 21 or the punching stamp 11 is intended to be moved along the positioning axis 16, the drive spindle 18 is rotated by the drive motor 142. The spindle nuts 141, 143 which engage with the drive spindle 18 are moved owing to the rotation of the drive spindle 18 in the same direction along the positioning axis 16 and carry the drive-side wedge gear elements 22, 23 and, via these, the output-side dual wedge 26 formed by the output-side dual wedge elements 24, 25 in their common movement direction. A movement of the output-side dual wedge 26 and the ram 12 with the punching stamp 11 exclusively along the positioning axis 16 is produced when the drive-side wedge gear elements 22, 23 move in the same direction and with corresponding speed along the positioning axis 16. This is the case when the spindle nut 141 is blocked by the drive motor 140 counter to a rotation about the rotation axis of the rotating drive spindle 18.

If the ram 12 and the punching stamp 11 are intended to carry out only a stroke movement along the stroke axis 14, the electrical motor 140 and the spindle nut 141, on the one hand, and the drive motor 142 and the drive spindle 18, on the other hand, must be operated in such a manner that the drive-side wedge gear elements 22, 23 are displaced with corresponding speed in opposing directions along the positioning axis 16. If the drive-side wedge gear elements 22, 23 move towards each other, the ram 12 with the punching stamp 11 is lowered via the output-side dual wedge 26 along the stroke axis 14. If the drive-side wedge gear elements 22, 23 move away from each other along the positioning axis 16 with corresponding speed, the output-side dual wedge 26 and the ram 12 are lifted along the stroke axis 14.

In order to superimpose a movement of the ram 12 and punching stamp 11 along the positioning axis 16 and a movement of the ram 12 and punching stamp 11 along the stroke axis 14, the drive motor 140 and the spindle nut 141 as well as the drive motor 142 and the drive spindle 18 are operated in such a manner that the drive-side wedge gear elements 22, 23 are displaced simultaneously in the same direction and relative to each other along the positioning axis 16.

The spindle drive arrangement 217 of FIG. 10 also has two spindle drives as motorized drive units 38, 39. In a modification of the spindle drives of the spindle drive arrangements 17, 117, however, the motorized drive units 38, 39 of the spindle drive arrangement 217 do not use a common carrier-structure-side drive device. Instead, each of the motorized drive units 38, 39 has its own drive spindle, wherein the motorized drive unit 38 has a drive spindle 51 and the motorized drive unit 39 has a drive spindle 52. The drive spindle 51 is driven by an electrical drive motor 53, the drive spindle 52 by an electrical drive motor 54 about the longitudinal axis thereof which extends along the positioning axis 16. The rotation of the drive spindle 51 brought about by the electrical drive motor 53 is converted by a spindle nut 55 which is fitted to the drive-side wedge gear element 22 in a rotationally secure manner into a linear movement of the drive-side wedge gear element 22. Accordingly, via the drive spindle 52 and a spindle nut 56 which is positioned thereon, the drive motor 54 drives the drive-side wedge gear element 23 along the positioning axis 16. The drive spindles 51, 52 are illustrated in FIG. 10 so as to be broken away. They are displaced relative to each other perpendicularly relative to the plane of the drawing of FIG. 10 and both extend over the entire length of the upper horizontal frame member 3 of the machine frame 2.

If the motorized drive units 38, 39 of FIG. 10 are operated or controlled in such a manner that the drive-side wedge gear elements 22, 23 move in the same direction and at the same speed along the positioning axis 16, there is produced exclusively a positioning movement of the stroke drive device 213 along the positioning axis 16. If the drive-side wedge gear elements 22, 23 are moved by the motorized drive units 38, 39 with corresponding speed in opposing directions along the positioning axis 16, there is produced exclusively a positioning movement of the ram 12 or the punching stamp 11 along the stroke axis 14. If the drive-side wedge gear elements 22, 23 move towards each other, the ram 12 with the punching stamp 11 is lowered along the stroke axis 14; if the drive-side wedge-like elements 22, 23 move apart from each other along the positioning axis 16, the ram 12 is lifted with the punching stamp 11 along the stroke axis 14.

Also in the case of the arrangement of FIG. 10, a positioning movement along the positioning axis 16 and a movement along the stroke axis 14 can be superimposed on each other by the drive-side wedge gear elements 22, 23 being moved along the positioning axis 16 in the same direction and relative to each other.

In the case of the stroke drive device 313 illustrated in FIG. 11, movements of the ram 12 and the punching stamp 11 along the stroke axis 14 are produced exclusively by the motorized drive unit 38 and positioning movements along the positioning axis 16 are produced exclusively by the motorized drive unit 39.

The motorized drive unit 38 includes an electrical drive motor 57 which drives a drive spindle 58 about the longitudinal axis thereof. The drive spindle 58 has two longitudinal portions 59, 60 with threads that run in opposite directions. The longitudinal portion 59 of the drive spindle 58 engages with a spindle nut 61 which is in turn connected to the drive-side wedge gear element 22 in a rotationally secure manner. Accordingly, the longitudinal portion 60 of the drive spindle 58 engages with a spindle nut 62 which is in turn assembled on the drive-side wedge gear element 23 in a rotationally secure manner.

Owing to the fact that the longitudinal portions 59, 60 of the drive spindle 58 are provided with threads that run in opposite directions, the drive-side wedge gear elements 22, 23 are displaced in opposite directions when the drive spindle 58 rotates. If the drive-side wedge gear elements 22, 23 move towards each other, the ram 12 is lowered with the punching stamp 11 along the stroke axis 14; if the drive-side wedge gear elements 22, 23 move apart from each other, the ram 12 with the punching stamp 11 is lifted along the stroke axis 14.

The motorized drive unit 39 of the spindle drive arrangement 317 has an electrical drive motor 63 and a drive spindle 64 which is driven thereby. The drive spindle 64 supports a spindle nut 65 which is fitted to a housing 66 in a rotationally secure manner. The motorized drive unit 38 with the drive-side wedge gear elements 22, 23 is accommodated inside the housing 66.

If only the motorized drive unit 38 is operated, there is produced a movement of the ram 12 along the stroke axis 14. When only the motorized drive unit 39 is operated, the ram 12 moves with the punching stamp 11 along the positioning axis 16. If both motorized drive units 38, 39 are operated at the same time, a movement of the ram 12 and punching stamp 11 along the stroke axis 14 and a movement of the ram 12 and punching stamp 11 along the positioning axis 16 are superimposed.

The invention claimed is:

1. A machine tool for processing workpieces comprising:

a stroke drive device configured to move a pressing tool along a stroke axis towards a workpiece and being positionable along a positioning axis which extends perpendicular to the stroke axis;

a motorized drive including two motorized drive units which are controlled independently of each other; and wedge gear elements between the motorized drive and the pressing tool, the wedge gear elements comprising:

two drive-side wedge gear elements, each drive-side wedge gear element being associated with a motorized drive unit, two output-side wedge gear elements attached to the pressing tool, each output-side wedge gear element being opposite to an associated respective drive-side wedge gear element and forming together with the associated drive-side wedge gear element a gear element pair, thus forming two gear element pairs, wherein the drive-side wedge gear element and the output-side wedge gear element of each of the two gear element pairs are opposite each other at wedge faces inclined at a wedge angle with respect to the positioning axis, wherein the wedge faces of the two gear element pairs are inclined in opposing directions with respect to the positioning axis, and wherein the motorized drive units are configured to a) move the drive-side wedge gear element of at least one of the two gear element pairs relative to its associated output-side wedge gear element along the positioning axis in order to move the pressing tool along the stroke axis, and b) position the stroke drive device including the two gear element pairs along the positioning axis by moving both gear element pairs including the drive-side wedge gear elements and the associated respective output-side wedge gear elements simultaneously in the same direction along the positioning axis of the stroke drive device.

2. The machine tool of claim 1, wherein the motorized drive units are configured to simultaneously move the drive-side wedge gear element of at least one of the two gear element pairs relative to its associated output-side wedge gear element along the positioning axis and both gear element pairs including the drive-side wedge gear elements and the associated output-side wedge gear elements simultaneously in the same direction along the positioning axis of the stroke drive device.

3. The machine tool of claim 1, wherein the motorized drive units are configured to simultaneously move the drive-side wedge gear elements of both gear element pairs relative to the associated output-side wedge gear element along the positioning axis in order to move the pressing tool along the stroke axis.

4. The machine tool of claim 1, wherein the motorized drive units are configured to move the drive-side wedge gear elements relative to the associated output-side wedge gear elements along the positioning axis in order to move the pressing tool in the stroke direction and/or carry the output-side wedge gear elements along the positioning axis to position the stroke drive device along the positioning axis.

5. The machine tool of claim 1, wherein one of the motorized drive units is configured to move the drive-side wedge gear element of the at least one of the two gear element pairs relative to its associated output-side wedge gear element along the positioning axis in order to move the pressing tool along the stroke axis, while the other of the motorized drive units is configured to move both gear element pairs including the drive-side wedge gear elements and the respective associated output-side wedge gear elements simultaneously in the same direction along the positioning axis of the stroke drive device in order to position the stroke drive device along the positioning axis, resulting in a move of the pressing tool along the stroke axis and along the positioning axis.

6. The machine tool of claim 1, wherein the drive-side wedge gear element of a first of the gear element pairs has two gear element portions separated by an intermediate space and which are offset relative to each other perpendicular to a movement plane defined by the stroke axis and the positioning axis, and which are opposite the associated output-side wedge gear element on the respective wedge face.

7. The machine tool of claim 6, wherein the drive-side wedge gear element of a second of the gear element pairs is arranged at the intermediate space of the drive-side wedge gear element of the first gear element pair, and wherein during a movement of one or both of the drive-side wedge gear elements along the positioning axis, the drive-side wedge gear element of the second gear element pair is received in the intermediate space of the drive-side wedge gear element of the first gear element pair.

8. The machine tool of claim 6, wherein the drive-side wedge gear element of the first gear element pair is U-shaped with two legs which form the gear element portions and are orientated parallel with the movement plane.

9. The machine tool of claim 1, wherein the output-side wedge gear elements are connected to a ram which is movably guided along the stroke axis and which moves the pressing tool along the stroke axis.

10. The machine tool of claim 9, wherein the output-side wedge gear elements attached to the ram guide the ram along the stroke axis.

11. The machine tool of claim 9, wherein the ram has a tool receiving member for the pressing tool and a rotary drive device by which the tool receiving member can be rotated about the stroke axis.

12. The machine tool of claim 1, wherein the motorized drive units each have a gear-side drive device which is moved together with one of the drive-side wedge gear elements along the positioning axis and wherein the gear-side drive devices cooperate with a carrier-structure-side drive device which is attached to a carrier structure of the machine tool and which is common to the two motorized drive units.

13. The machine tool of claim 1, wherein at least one of the motorized drive units comprises a spindle drive.

14. The machine tool of claim 12, wherein the motorized drive units each comprise a spindle drive, wherein each of the spindle drives comprises a spindle nut of a gear-side drive device and wherein the spindle drives comprise a common drive spindle of a carrier-structure-side drive device which extends along the positioning axis of the stroke drive device and on which the spindle nuts of the spindle drives are positioned.

15. The machine tool of claim 14, wherein at least one of the spindle drives comprises a drive motor which drives the associated spindle nut along the drive spindle.

16. The machine of claim 15, wherein the drive motor of the at least one of the spindle drives is, together with the associated spindle nut, included in the gear-side drive device.

17. The machine tool of claim 1, wherein at least one of the motorized drive units is a linear motor.

18. The machine tool of claim 17, wherein the linear motor has as a gear-side drive device, a primary part, and a common carrier-structure-side drive device in the form of a common secondary part which extends along the positioning axis of the stroke drive device.

19. The machine tool of claim 1, wherein the machine tool has a carrier structure in the form of an O-shaped machine frame which encloses an inner frame space and wherein the stroke drive device is arranged in the inner frame space and is guided on the O-shaped machine frame to be positioned along the positioning axis which extends in the peripheral direction of the O-shaped machine frame.

* * * * *